US010010181B2

(12) United States Patent
Olm

(10) Patent No.: US 10,010,181 B2
(45) Date of Patent: Jul. 3, 2018

(54) CUSHION FOR ALLEVIATING PAIN

(71) Applicant: Sit & Sigh Ltd., Glasgow (GB)

(72) Inventor: Chad Olm, Glasgow (GB)

( * ) Notice: Subject to any disclaimer, the term of this patent is extended or adjusted under 35 U.S.C. 154(b) by 0 days.

(21) Appl. No.: 15/317,919

(22) PCT Filed: May 29, 2015

(86) PCT No.: PCT/EP2015/061998
§ 371 (c)(1),
(2) Date: Dec. 9, 2016

(87) PCT Pub. No.: WO2015/189054
PCT Pub. Date: Dec. 17, 2015

(65) Prior Publication Data

US 2017/0119161 A1 May 4, 2017

(30) Foreign Application Priority Data

Jun. 10, 2014 (GB) ..... 1410266.9
Oct. 16, 2014 (GB) ..... 1418352.9

(51) Int. Cl.

| | |
|---|---|
| ***A47C 7/02*** | (2006.01) |
| ***A47C 7/18*** | (2006.01) |
| ***A47C 31/11*** | (2006.01) |
| ***A47C 7/22*** | (2006.01) |
| ***A47K 3/12*** | (2006.01) |

(52) U.S. Cl.
CPC ..... *A47C 7/021* (2013.01); *A47C 7/022* (2013.01); *A47C 7/18* (2013.01); *A47C 7/22* (2013.01); *A47C 31/116* (2013.01); *A47K 3/122* (2013.01)

(58) Field of Classification Search
None
See application file for complete search history.

(56) References Cited

U.S. PATENT DOCUMENTS

| | | | | |
|---|---|---|---|---|
| 2,483,077 A | | 9/1949 | Walsh | |
| 3,050,748 A | | 8/1962 | Deutinger | |
| 3,205,010 A | | 10/1965 | Schick | |
| 3,987,507 A | * | 10/1976 | Hall | A47C 7/18 297/DIG. 1 |
| 4,646,374 A | | 3/1987 | Shafer | |
| 4,712,833 A | * | 12/1987 | Swanson | A47D 1/004 297/219.12 |
| 4,824,169 A | | 4/1989 | Jarrell | |
| 4,891,848 A | | 1/1990 | Carter | |
| 5,140,713 A | | 9/1992 | Pesterfield | |
| 5,282,286 A | * | 2/1994 | MacLeish | A47C 4/54 297/469 |

(Continued)

FOREIGN PATENT DOCUMENTS

| | | |
|---|---|---|
| BE | 546541 | 10/1959 |
| DE | 8513991 U1 | 10/1985 |

(Continued)

*Primary Examiner* — David E Allred

(57) ABSTRACT

A cushion (10) device comprising: a planar support member (20) formed from a resilient material which defines a front (22), rear (24, 64) and two side portions (26) of the support member (20), wherein a recess (40) is provided at the rear (24, 64) portion of the support member (20) at a mid-position between the two side portions (26), and wherein the support member (20) includes two opposing wing members (42) extending laterally into the recess (40) towards the mid-position.

18 Claims, 4 Drawing Sheets

(56) References Cited

U.S. PATENT DOCUMENTS

| | | | | |
|---|---|---|---|---|
| D359,870 | S | 7/1995 | McLaughlin | |
| 5,487,197 | A * | 1/1996 | Iskra, Jr. | A47C 7/021 297/452.41 |
| 5,687,436 | A | 11/1997 | Denton | |
| 6,012,188 | A * | 1/2000 | Daniels | A47C 7/021 297/284.6 |
| 6,036,271 | A * | 3/2000 | Wilkinson | A61G 5/1043 297/219.1 |
| 6,457,773 | B1 | 10/2002 | Gates | |
| 6,820,938 | B2 * | 11/2004 | Barrett | A47C 7/022 297/4 |
| 8,516,638 | B2 * | 8/2013 | Kummerfeld | A47D 13/00 248/118 |
| 9,468,299 | B2 * | 10/2016 | Featherstone | A47C 7/14 |
| 2003/0194277 | A1 * | 10/2003 | Courtney | B63C 9/08 405/186 |
| 2006/0185093 | A1 | 8/2006 | Yu | |
| 2006/0272084 | A1 | 12/2006 | Bauman | |
| 2013/0198961 | A1 | 8/2013 | Davis et al. | |
| 2017/0150819 | A1 * | 6/2017 | Jones | A47C 27/10 |
| 2017/0181883 | A1 * | 6/2017 | Patel | A61F 5/3784 |

FOREIGN PATENT DOCUMENTS

| | | |
|---|---|---|
| DE | 29803709 | 4/1998 |
| DE | 20210791 | 10/2002 |
| EP | 0093065 | 11/1983 |
| GB | 1065909 | 4/1967 |
| GB | 2453322 | 4/2009 |
| JP | 2003289993 | 10/2003 |
| JP | H09224787 | 10/2003 |
| KR | 20070109168 A * | 11/2007 |
| WO | WO97/46148 | 12/1997 |
| WO | WO2011/121249 | 10/2011 |

* cited by examiner

CUSHION FOR ALLEVIATING PAIN

The present invention relates to apparatus for eliminating or reducing pain, such as coccyx pain, Pelvic Girdle Pain (PGP), Symphysis Pubis Dysfunction (SPD) or other similar conditions. In particularly, but not exclusively, the invention relates to cushions for eliminating or reducing pain.

Many people suffer or have suffered from coccydynia, which is pain in the coccyx or tailbone. This can occur for a number of reasons, such as falling on the coccyx or sitting too long in the same position. Coccydynia occurs five times more frequently in women than in men and is more frequent during or after pregnancy. Pregnant women can also suffer from PGP, which relates to pain or a limitation of mobility and functioning in any of the three pelvic joints.

It is known to provide modified cushions for sufferers of coccydynia. These cushions have a U shaped cut-out at the rear of the cushion so that the user's coccyx is not supported by, or even contacting, the cushion. Also, the cushion can be wedge-shaped, tapering down from the rear to the front portion. This helps to tilt the pelvis slightly forward to restore the natural curve of the backbone.

However, the applicant has found that the 'cushion gap' provided by the U shaped cut-outs of known coccyx cushions tends to be too large. This reduces the area of support provided by the cushion which reduces comfort. In particular, it has been found that the U shape of the cut-out is not the most appropriate shape, considering the anatomy (position of the coccyx) of the user.

Other than cushions, sufferers are often advised to regularly take warm baths to relieve pain. However, the surface of the bath is hard and it is difficult for the sufferer to position themselves in the bath in such a way that the bath surface is not pressing on the coccyx. Also, in trying to adopt a comfortable position, the sufferer can inadvertently slide forward in the bath, transferring pressure rearwards on to the coccyx.

Known coccyx cushions are not suitable for use in a bath as they are not waterproof. Also, due to the curved surface of the bath, it can be difficult or impossible to locate a coccyx cushion far enough back so that it is in the correct position for a user who is resting with their back against the bath surface. Inflatable rings are available for use in the bath but these are not appropriate for sufferers of coccydynia or pelvic conditions. Also, the cushions tend to slide forwards on the bath surface due to a lack of friction, again transferring pressure rearwards on to the coccyx. Furthermore, the wedge profile of many cushion can exacerbate the problem of the user inadvertently sliding forward.

Known cushions are also fixed in terms of their resilience. Specifically, known cushions all have foam inserts having a similar density. However, users vary greatly in their mass and a lighter or heavier than average user will not receive the same benefit from the cushion. Even the same user may be a pregnant woman who gains substantial weight during pregnancy but then becomes substantially lighter after giving birth.

Also, known cushions are fixed in shape and tend to be bulky. They are therefore not particularly portable. Sufferers would often like to take the cushion with them, say to work or a restaurant, but they are too large for a typical handbag. Also, many sufferers find their condition to be embarrassing and do not wish others to know that they are using the cushion.

It is desirable to provide cushions which have a more suitable cut-out and/or which increase comfort for the user.

It is desirable to provide cushions which are appropriate for use in a bath.

It is desirable to provide cushions having a resilience and/or foam density which is adjustable.

It is desirable to provide cushions which are more portable or more discrete.

According to a first aspect of the present invention there is provided a cushion device comprising:

- a first planar support member formed from a resilient material which defines a front, rear and two side portions of the support member,
- wherein a recess is provided at the rear portion of the support member at a mid-position between the two side portions,
- and wherein the support member includes two opposing wing members extending laterally into the recess towards the mid-position.

Each wing member may be formed from a resilient material. The resilient material may be the same as the resilient material of the support member. Alternatively, the resilient material of the wing members may have a greater or lesser resilience than that of the support member.

Each wing member may extend laterally into the recess towards but not reach the mid-position, thus maintaining a gap at the mid-position.

Each wing member may be substantially arcuate.

The horizontal profile of the recess with the wing members may substantially correspond to a horizontal profile or 'footprint' formed by the buttocks of a user in a seated position.

The support member may include an indentation on its supporting surface. The profile of the indentation may substantially correspond to a horizontal profile or 'footprint' formed by at least the buttocks of a user in a seated position.

The cushion may include a strap member which extends across the recess. The strap member may have a top edge which is below the upper surface of the support member.

The support member may be wedge-shaped. The support member may have a thickness which tapers down from the rear to the front portion.

The cushion device maybe adapted for use under water.

The cushion device may include a covering which is waterproof. The covering may include an opening for inserting the support member. The opening may be sealed closed.

Alternatively or in addition, the resilient material may be waterproof. The resilient material may comprise a closed cell foam material. Alternatively, the resilient material may be provided with a waterproof layer on at least a top and bottom surface of the resilient material.

The cushion device may include gripping means provided at the undersurface of the support member. The gripping means may include one or more suction devices adapted to form at least a partial vacuum with a surface supporting the cushion device.

The cushion device may include a second planar support member which is separate from and connected to the first planar support member. The second support member may be connected to the rear portion of the first support member.

The second support member may be connected to the first support member by one or more flexible connectors which allow the second support member to rotate or fold relative to the first support member. Two flexible connectors may be provided, one on each side of the recess.

Gripping means may be provided at the undersurface of the second support member. Gripping means may be provided at the or each flexible connector.

The second support member may include an indentation on its supporting surface. The profile of the indentation may substantially correspond to a profile formed by the back of a user.

The support member may have a thickness which tapers down from the front to the rear portion.

The opening of the covering may be openable and reclosable by a user. The cushion device may be provided with a plurality of support members. The support members may vary in their resilience. The support members may be formed from a foam material having a range of densities.

Alternatively or in addition, the support member may comprise a plurality of stackable layers. Each layer may vary in its resilience or density. The covering may be adapted to accept a varying amount of stacked layers such that the overall resilience or density of the support member is adjustable.

The support member may be adjustable from a first shape or configuration in which it is planar to a second shape or configuration. The second shape or configuration may be substantially cubic or cuboidal.

The support member may be foldable. The support member may be foldable about a plurality of fold lines.

Alternatively, the support member may comprise a plurality of sections which are detachable and reattachable to each other.

According to a second aspect of the present invention there is provided a cushion device comprising:

- a first planar support member formed from a resilient material;
- a covering which covers the first support member,
- wherein at least one of the first support member and the covering is waterproof.

The covering may include an opening for inserting the support member. The opening may be sealed closed.

The resilient material may comprise a closed cell foam material. Alternatively, the resilient material may be provided with a waterproof layer on at least a top and bottom surface of the resilient material.

The first support member may define front, rear and two side portions of the first support member. A recess may be provided at the rear portion of the first support member at a mid-position between the two side portions.

The cushion device may include gripping means provided at the undersurface of the first support member. The gripping means may include one or more suction devices adapted to form at least a partial vacuum with a surface supporting the cushion device.

The cushion device may include a second planar support member which is separate from and connected to the first planar support member. The second support member may be connected to the rear portion of the first support member.

The second support member may be formed from a resilient material. The second support member may include a covering which covers the second support member. At least one of the second support member and the covering may be waterproof.

The second support member may be connected to the first support member by one or more flexible connectors which allow the second support member to rotate or fold relative to the first support member. Two flexible connectors may be provided, one on each side of the recess.

Gripping means may be provided at the undersurface of the second support member. Gripping means may be provided at the or each flexible connector.

The second support member may include an indentation on its supporting surface. The profile of the indentation may substantially correspond to a profile formed by the back of a user.

The first support member may have a thickness which tapers down from the front to the rear portion.

The first support member may include two opposing wing members extending laterally into the recess towards the mid-position.

Each wing member may be formed from a resilient material. The resilient material may be the same as the resilient material of the support member. Alternatively, the resilient material of the wing members may have a greater or lesser resilience than that of the first support member.

Each wing member may extend laterally into the recess towards but not reach the mid-position, thus maintaining a gap at the mid-position.

Each wing member may be substantially arcuate.

The horizontal profile of the recess with the wing members may substantially correspond to a horizontal profile or 'footprint' formed by the buttocks of a user in a seated position.

The first support member may include an indentation on its supporting surface. The profile of the indentation may substantially correspond to a horizontal profile or 'footprint' formed by at least the buttocks of a user in a seated position.

The opening of the covering may be openable and reclosable by a user. The cushion device may be provided with a plurality of support members. The support members may vary in their resilience. The support members may be formed from a foam material having a range of densities.

The first support member may be adjustable from a first shape or configuration in which it is planar to a second shape or configuration. The second shape or configuration may be substantially cubic or cuboidal.

The first support member may be foldable. The first support member may be foldable about a plurality of fold lines.

According to a third aspect of the present invention there is provided a cushion device comprising:

- a plurality of planar support members formed from a resilient material; and
- a covering which covers at least one support member,
- wherein the resilient material of each support member varies in its resilience or density.

The covering may be openable and reclosable by a user.

The support members may be formed from a foam material having a range of densities.

Alternatively or in addition, the support member may comprise a plurality of stackable layers. Each layer may vary in its resilience or density. The covering may be adapted to accept a varying amount of stacked layers such that the overall resilience or density of the support member is adjustable.

The plurality of stackable layers may comprise a first bottom layer having a first density and a second layer positioned above the first bottom layer, the second layer having a second lesser density.

The plurality of stackable layers may comprise a layer of memory foam material. The layer of memory foam material may be provided as a third top layer above the first and second layers.

Each support member may define a front, rear and two side portions of the support member. A recess may be provided at the rear portion of the support member at a mid-position between the two side portions.

Each support member may include two opposing wing members which extend laterally into the recess towards the mid-position. Each wing member may extend laterally into the recess towards but not reach the mid-position, this maintaining a gap at the mid-position.

Each wing member may be substantially arcuate. The horizontal profile of the recess with the wing members may substantially correspond to a horizontal profile or 'footprint' formed by the buttocks of a user in a seated position.

The cushion may include a strap member which extends across the recess. The strap member may have a top edge which is below the upper surface of the support member.

The support member may be wedge-shaped. The support member may have a thickness which tapers down from the rear to the front portion.

The cushion device may be adapted for use under water. The cushion device may include a covering which is waterproof. The covering may include an opening for inserting the support member. The opening may be sealed closed.

Alternatively or in addition, the resilient material may be waterproof. The resilient material may comprise a closed cell foam material. Alternatively, the resilient material may be provided with a waterproof layer on at least a top and bottom surface of the resilient material.

The cushion device may include gripping means provided at the undersurface of the support member. The gripping means may include one or more suction devices adapted to form at least a partial vacuum with a surface supporting the cushion device.

The support member may have a thickness which tapers down from the front to the rear portion.

The support member may be adjustable from a first shape or configuration in which it is planar to a second shape or configuration. The second shape or configuration may be substantially cubic or cuboidal.

The support member may be foldable. The support member may be foldable about a plurality of fold lines.

Alternatively, the support member may comprise a plurality of sections which are detachable and reattachable to each other.

According to a fourth aspect of the present invention there is provided a cushion device comprising:

a support member formed from a resilient material, wherein the support member is adjustable from a first shape or configuration in which it is planar to a second shape or configuration.

The second shape or configuration may be substantially cubic or cuboidal.

The support member may be foldable. The term 'foldable' is intended to include two portions or sections which are pivotable relative to each other.

The support member may be foldable about a plurality of fold lines.

The support member in its first shape or configuration may defines a front, rear and two side portions of the support member and may define an upper and a bottom surface.

A first fold line may be provided which extends laterally between the two side portions. The first fold line may be provided at a mid-position between the front and rear portions. The first fold line may be provided at the upper surface. Alternatively, the first fold line may be provided at the lower surface.

When the support member is in its first planar shape or configuration, the support member may be foldable about the first fold line and about a horizontal axis to an intermediate shape or configuration.

The intermediate shape or configuration may define intermediate front, rear and two side portions of the support member.

A second fold line may be provided which extends longitudinally between the intermediate front and rear portions. The second fold line may be provided at a mid-position between the intermediate side portions.

When the support member is in its intermediate shape or configuration, the support member may be foldable about the second fold line and about a vertical axis to the second shape or configuration.

Alternatively, the support member may comprise a plurality of sections which are detachable and reattachable to each other.

The support member may be wedge-shaped. The support member may have a thickness which tapers down from the rear to the front portion. Alternatively, the support member may have a thickness which tapers down from the front to the rear portion.

The wedge-shaped support member may be adapted such that, when folded, two stacked layers of the wedge-shaped support member provide a body having a square or rectangular cross section.

A recess may be provided at the rear portion of the support member at a mid-position between the two side portions. The support member may include two opposing wing members extending laterally into the recess towards the mid-position.

Each wing member may extend laterally into the recess towards but not reach the mid-position, this maintaining a gap at the mid-position.

Each wing member may be substantially arcuate.

The horizontal profile of the recess with the wing members may substantially correspond to a horizontal profile or 'footprint' formed by the buttocks of a user in a seated position.

The cushion device maybe adapted for use under water.

The cushion device may include a covering which is waterproof. The covering may include an opening for inserting the support member. The opening may be sealed closed.

Alternatively or in addition, the resilient material may be waterproof. The resilient material may comprise a closed cell foam material. Alternatively, the resilient material may be provided with a waterproof layer on at least a top and bottom surface of the resilient material.

The cushion device may include gripping means provided at the undersurface of the support member. The gripping means may include one or more suction devices adapted to form at least a partial vacuum with a surface supporting the cushion device.

The opening of the covering may be openable and reclosable by a user. The cushion device may be provided with a plurality of support members. The support members may vary in their resilience. The support members may be formed from a foam material having a range of densities.

Embodiments of the present invention will now be described, by way of example only, with reference to the accompanying drawings in which.

Figure 1:
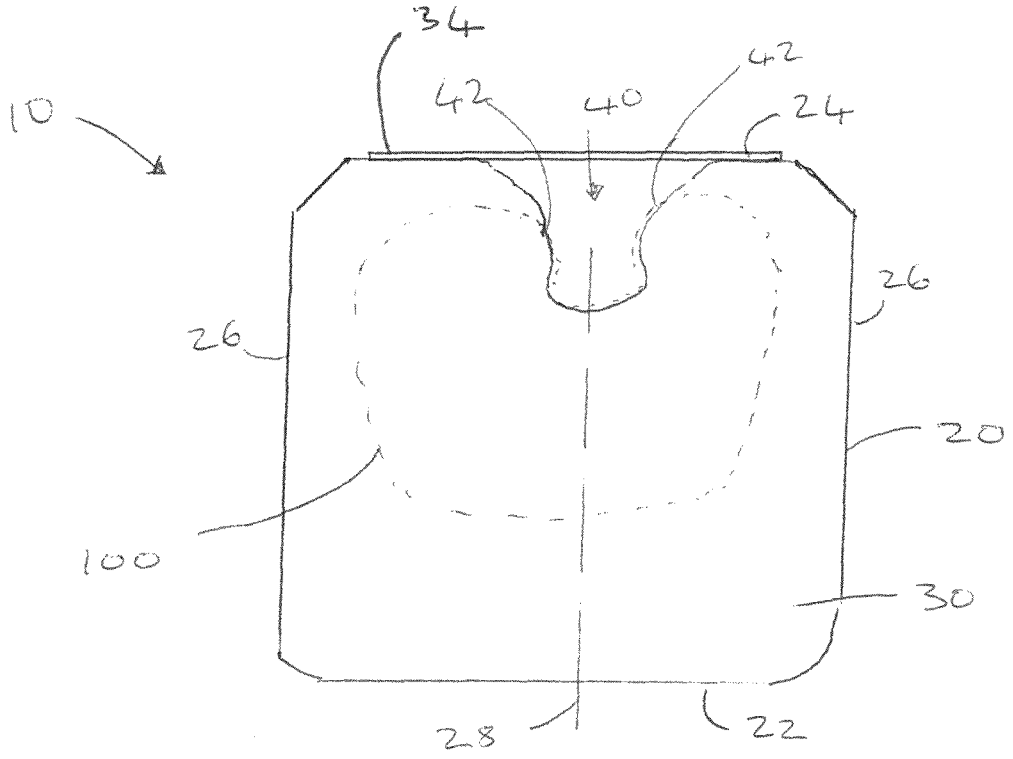
FIG. 1 is a plan view of a cushion device according to a first embodiment of the invention and also shows a horizontal profile of a user's buttocks when sitting on the cushion device.

FIG. 1 shows a first embodiment of a cushion device 10. The cushion 10 comprises a planar support member 20 within a covering 30. The support member 20 is formed from a resilient material, such as a foam material. The covering 30 has an opening 32 at the rear to allow insertion of the support member 20.

The support member 20 defines a front 22, rear 24 and two side 26 portions. A recess 40 is provided at the rear 24 of the support member 20, at a mid-position 28 between the two side portions 26.

The support member 20 also includes two opposing wing members 42 which extend laterally into the recess 40 towards, but not reaching, the mid-position 28. Each wing member 42 is formed from the same resilient material as that of the support member 20. However, in an alternative embodiment, the resilient material of the wing members 42 could have a greater resilience than that of the support member 20. This could increase comfort for the user at a critical area of the cushion 10.

Each wing member 42 is arcuate. The resulting horizontal profile of the recess 40 with the wing members 42 corresponds closely to the shown horizontal profile 100 or 'footprint' of the buttocks of a user in a seated position. Therefore, in contrast with known coccyx cushions, the support member 20 has an increased support area for the user. A gap is still provided at the location of the user's coccyx.

The support member 20 also includes chamfered corners at the rear 24. This allows the cushion 10 to be used on the seat of a vehicle.

The cushion 10 has a strap 34 at the rear 24 of the support member 20. The strap 34 extends across the recess 40. As well as providing a carrying handle, the strap 34 maintains the cushion's 10 shape and structure when sat upon by a user. As in all coccyx cushions, the recess reduces the stiffness of the cushion at the rear and they can splay in use. The strap 34 prevents this. Also, the wings 42 increase the stiffness at the rear 24 relative to known cushions.

The strap 34 can have a resilience so that some displacement at the rear of the cushion 10 is allowed. This can be set to maximise comfort for the user.

The top edge of the strap 34 is positioned well below the upper surface of the support member 20. Indeed, the top edge is below the opening 32. This ensures that the strap will not contact a user in use. Also, it will not interfere when inserting the support member 20 into the opening 32.

Figure 2:
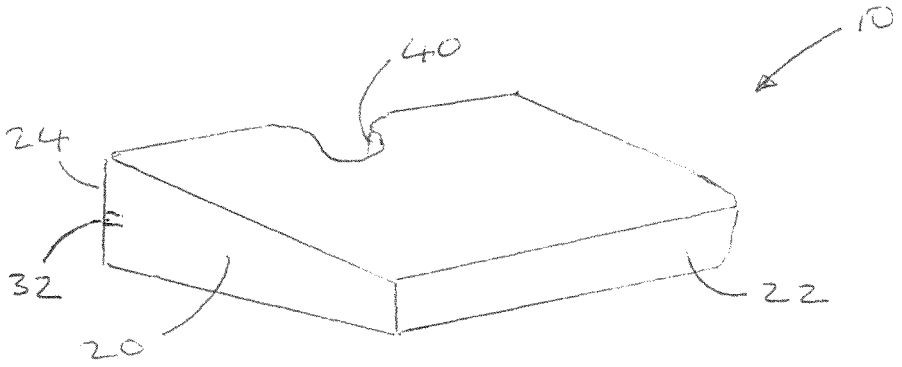
FIG. 2 is a perspective view of the cushion device of FIG. 1.

As seen in FIG. 2, the support member 20 is wedge-shaped. The support member 20 has a thickness which tapers down from the rear 24 to the front 22 portion. This helps to tilt the user's pelvis slightly forward to restore the natural curve of the backbone.

Figure 3:
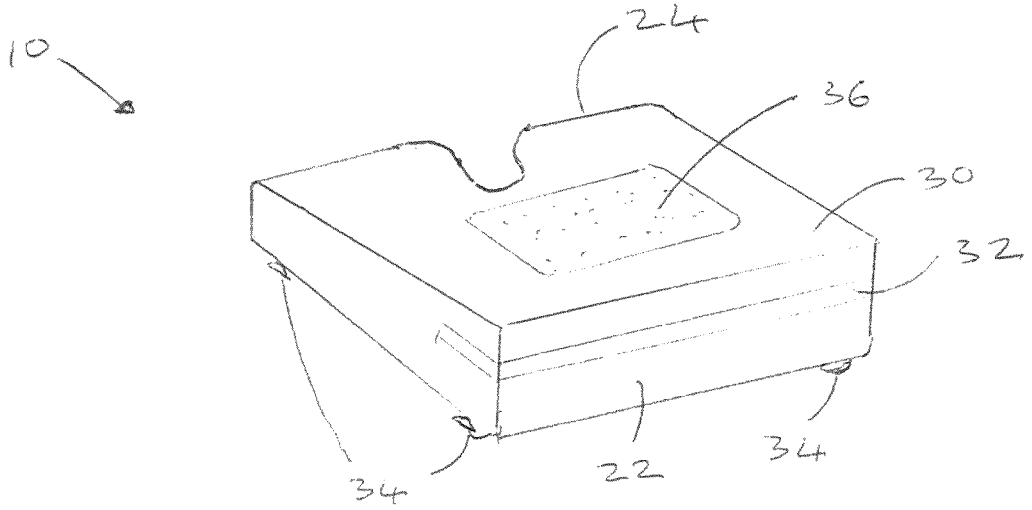
FIG. 3 is a perspective view of a cushion device according to a second embodiment of the invention.

FIG. 3 shows a second embodiment of a cushion device and like features are given like reference numerals.

In this embodiment, the cushion 10 is adapted for use under water. The cushion 10 includes a covering 30 which is waterproof. The covering has an opening 32 for inserting the support member 20 and this opening 32 is sealed closed.

It is also possible to form the resilient material to be waterproof. This could be done using a closed cell foam material or applying a waterproof coating or layer to the top and bottom surface of the resilient material. Alternatively, after injection moulding of the resilient material, it is possible to allow a skin to develop during cooling which could act as the coating.

Gripping means is provided at the undersurface of the support member 20. This comprises a number of suction cups 34 which form a vacuum with a surface, such as a bath surface. This prevents the cushion 10 sliding forwards relative to the surface.

In this embodiment, the support member 20 has a thickness which tapers down from the front 22 to the rear 24 portions. This helps to prevent the user sliding forwards relative to the cushion 10. In addition, further gripping means in the form of a roughened area 36 is provided on the top surface of the support member 20, to prevent the user sliding forwards relative to the cushion 10.

Figure 4:
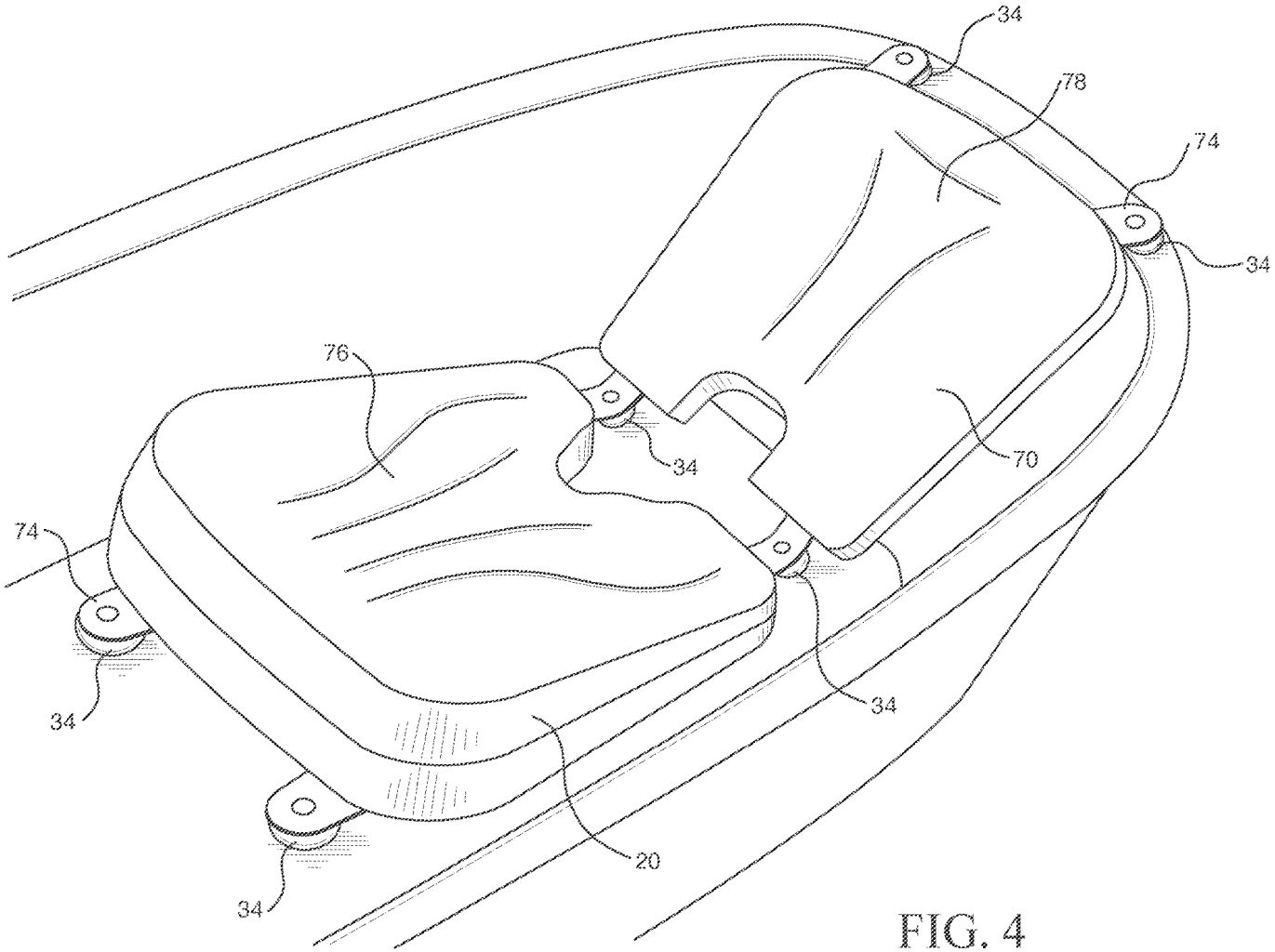
FIG. 4 is a perspective view of a cushion device according to a third embodiment of the invention located in a bath.
Figure 5:
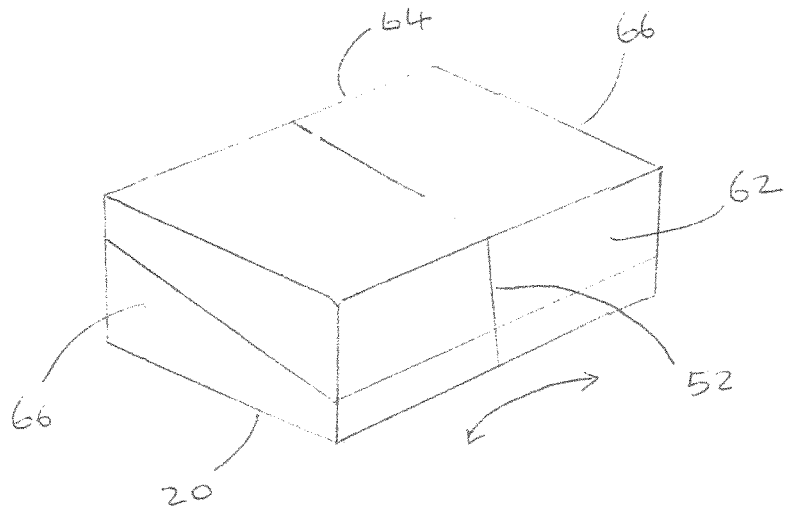
Figure 5:
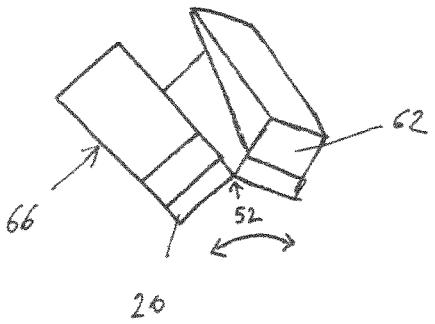
Figure 5:
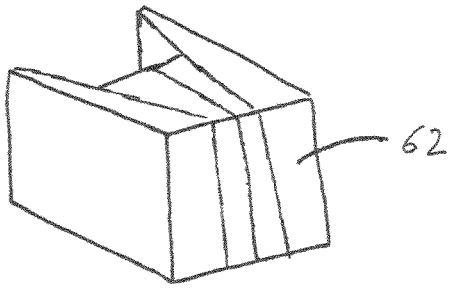

FIG. 4 shows a third embodiment of a cushion device and like features are given like reference numerals.

In this embodiment, the cushion 10 is again adapted for use under water and the cushion 10 is shown located in a bath 100. The cushion 10 includes a second planar support member 70 which is separate from, and connected to, the rear portion of the first support member 20.

The second support member 70 is connected to the first support member 20 by two flexible connectors or straps 72 which allow the second support member 70 to fold relative to the first support member 20. A strap 72 is provided on each side of the recess 40 of the first support member 20. The second support member 70 also includes a recess so that it is unlikely to contact the coccyx of a user even if poorly positioned.

The straps 72 also provide a gap between the two support surfaces with the straps 72 bridging the gap. The first support member 20 can be located as rearward as the curved surface of the bath allows. The second support member 70 can then be located at the correct position for a user even if this means the second support member 70 is located at a vertical height from the base of the bath surface.

Gripping means, again in the form of a number of suction cups 34, is provided. Tabs 74 extend laterally from the undersurface of the first support member 20 and the second support member 70 and the suction cups 34 are provided at these tabs 74. Suction cups 34 are also provided at each strap 72.

The first support member 20 includes an indentation 76 on its supporting surface. The profile of the indentation substantially corresponds to a horizontal profile or 'footprint' formed by the buttocks and extending legs of a user in a seated position. The second support member also includes an indentation on its supporting surface. The profile of the indentation substantially corresponds to a profile formed by the back of the user.

In an alternative embodiment, the cushion 10 can be adapted to be adjustable in its resilience to suit users of varying mass. The opening 32 of the covering 30 is openable and reclosable by a user. A plurality of support members 20 are provided, each varying in their resilience. The support members 20 can be formed from a foam material having a range of densities.

In an alternative embodiment, the support member 20 can comprise a number of stackable layers, each layer varying in its resilience or density. The use can select how many layers to insert into the covering 32 to set the overall resilience or density of the support member 20.

Figure 5:
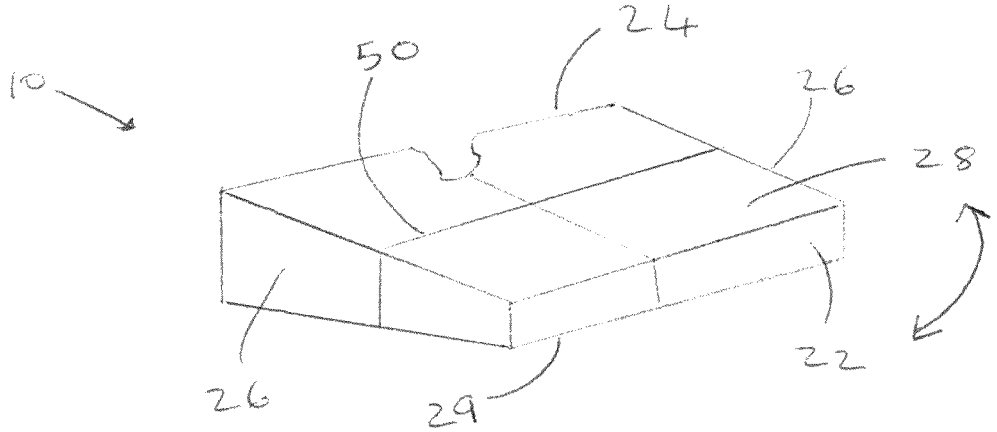
FIG. 5 is a perspective view of a cushion device according to a fourth embodiment of the invention in a a) first, b) intermediate and c) during folding and d) second configuration.

FIG. 5 shows a fourth embodiment of a cushion device and like features are given like reference numerals.

In this embodiment, the support member 20 is adjustable from a first configuration (shown in FIG. 5(*a*)) in which it is planar to a second configuration (shown in FIG. 5(*d*)) in which it is cubic or cuboidal. The support member 20 is foldable about two fold lines.

As shown in FIG. 5(*a*), the support member 20 in its first configuration defines the front 22, rear 24 and side 26 portions of the support member and also an upper 28 and a bottom 29 surface.

A first fold line 50 extends laterally between the two side portions 26 at a mid-position between the front 22 and rear 24 portions. The first fold line 50 is provided at the upper surface 28. The support member 20 can be folded about the first fold line 50 (which represents a horizontal axis) to an intermediate configuration which is shown in FIG. 5 (*b*).

The intermediate configuration defines an intermediate front 62, rear 64 and two side 66 portions of the support member 20. A second fold line 52 is provided at a mid-position between the intermediate side portions 66 and extends longitudinally between the intermediate front 62 and rear 64 portions.

The support member 20 can be folded (see FIG. 5(*c*)) about the second fold line 52 (which represents a horizontal axis) to the second shape or configuration which is shown in FIG. 5(*d*).

The cushion 10 is more compact in this configuration and therefore more portable. Also, the recess 40 has been divided and reconfigured and will be much less obvious to others. The cushion 10 is therefore more discreet in this configuration.

As in the first embodiment, the support member 20 is wedge-shaped, having a thickness which tapers down from the rear 24 to the front 22 portion. Due to this wedge-shape, the support member 20 when folded will have two stacked layers which provide a body having a rectangular cross section.

In an alternative embodiment, the support member 20 could comprise a number of sections which are detachable and reattachable to each other.

Various modifications and variations can be made without departing from the scope of the present invention.

What is claimed is:

1. A cushion device comprising:

a planar wedge-shaped support member formed from a resilient material which defines a front, rear and two side portions of the support member, wherein a recess is provided at the rear portion of the support member at a mid-position between the two side portions, a covering, the support member positioned within the covering, the covering having an opening on a rear face of the covering to allow insertion or removal of the support member from the covering, wherein the rear face of the covering is supported by the rear portion of the support member, and wherein the support member includes two opposing substantially arcuate wing members extending laterally into the recess towards but not reaching the mid-position and maintaining a gap at the mid-position, and a strap member which extends across the recess on the rear face of the covering and which maintains the shape and structure of the device when sat upon by a user, wherein the strap member has a top edge which is below the opening in the covering.

2. A cushion device as claimed in claim 1, wherein each wing member is formed from a resilient material having the same resilience as the first support member.

3. A cushion device as claimed in claim 1, wherein the support member includes an indentation on its supporting surface, the profile of the indentation adapted to substantially correspond to a horizontal profile formed by at least the buttocks of a user in a seated position.

4. A cushion device as claimed in claim 1, wherein the support member has a thickness which tapers down from the rear to the front portion.

5. A cushion device as claimed in claim 1, wherein the support member has a thickness which tapers down from the front to the rear portion.

6. A cushion device as claimed in claim 1, wherein the cushion device is adapted for use under water.

7. A cushion device as claimed in claim 1, including gripping means provided at the undersurface of the support member.

8. A cushion device as claimed in claim 7, wherein the gripping means includes one or more suction devices adapted to form at least a partial vacuum with a surface supporting the cushion device.

9. A cushion device as claimed in claim 1, wherein the support member comprises a first planar support member and a second planar support member which is separate from and connected to a rear of the first planar support member.

10. A cushion device as claimed in claim 9, wherein the second support member is connected to the first support member by one or more flexible connectors which allow the second support member to rotate or fold relative to the first support member.

11. A cushion device as claimed in claim 1, wherein the cushion device is provided with a plurality of support members which collectively form the first support member.

12. A cushion device as claimed in claim 11, wherein the support members vary in their resilience.

13. A cushion device as claimed in claim 11, wherein the support members are formed from a foam material having a range of densities.

14. A cushion device as claimed in claim 1, wherein the support member is adjustable from a first shape or configuration in which it is planar to a second shape or configuration.

15. A cushion device as claimed in claim 14, wherein the second shape or configuration is substantially cubic or cuboidal.

16. A cushion device as claimed in claim 1, wherein each wing member is formed from a resilient material having a resilience different from the first support member.

17. A cushion device as claimed in claim 1, wherein the wings increase the stiffness of the rear portion.

18. A cushion device as claimed in claim 1, wherein said strap has some resilience to allow limited displacement.

* * * * *